US006030327A

United States Patent [19]

Suomalainen et al.

[11] Patent Number: 6,030,327

[45] Date of Patent: Feb. 29, 2000

[54] COUPLING FOR THE TENDING-SIDE END OF A ROLL IN A PAPER MACHINE OR PAPER FINISHING MACHINE

[75] Inventors: Jyri Suomalainen, Helsinki; Miikka Kettunen, Jyväskylä ; Hannu Hyvönen, Vesanka, all of Finland

[73] Assignee: Valmet Corporation, Helsinki, Finland

[21] Appl. No.: 09/038,663

[22] Filed: Mar. 11, 1998

[30] Foreign Application Priority Data

Feb. 6, 1998 [FI] Finland ..... 980270

[51] Int. Cl.[7] ..... B23P 15/00

[52] U.S. Cl. ..... 492/47; 162/272

[58] Field of Search ..... 492/46, 47, 20; 162/272

[56] References Cited

U.S. PATENT DOCUMENTS 4,757,582 7/1988 Verkasalo ..... 492/46

4,781,795 11/1988 Miller ..... 492/46

5,895,598 4/1999 Kitano et al. ..... 492/46

*Primary Examiner*—Irene Cuda

*Assistant Examiner*—Marc W. Butler

*Attorney, Agent, or Firm*—Steinberg & Raskin, P.C.

[57] ABSTRACT

A coupling arrangement for the tending-side end of a roll in a paper machine, such as a suction roll or a variable-crown roll, or a roll in a paper finishing machine, such as a variablecrown roll or a heated roll in a calender for paper. Through this coupling arrangement, energy media are passed into the roll, such as pressure fluid and/or compressed air, lubricating media, such as lubrication oil and/or water, and cleaning media, such as hot water. The coupling arrangement includes an openable shield casing which is tightly connected with the tending-side end of the roll and a coupling flange or coupling flanges to which the various pipes and/or hoses are attached. In the interior of the shield casing, there are connecting pipes and/or hoses which connect the pipe parts of the roll end with the hose and/or pipe parts departing from the coupling arrangement.

18 Claims, 6 Drawing Sheets

COUPLING FOR THE TENDING-SIDE END OF A ROLL IN A PAPER MACHINE OR PAPER FINISHING MACHINE

FIELD OF THE INVETION

The present invention relates to a coupling arrangement for the tending-side end of a roll in a paper machine, in particular a suction roll or a variable-crown roll, or a roll in a paper finishing machine, such as a variable-crown roll or a heated roll in a calender for paper, through which coupling arrangement energy media are passed into the roll, such as pressure fluid and/or compressed air, lubricating media, such as lubrication oil and/or water, and cleaning media, such as hot water.

The present invention is generally related to the coupling arrangements at an end of different process rolls in a paper machine or paper finishing machine. Applications of the invention include at least the following rolls: suction rolls in a former and in a press in a paper machine, SymZL™ rolls in the press, SymBelt™ rolls in the press, and SymBelt™ rolls in on-line or off-line calenders, as well as heated rolls of soft calenders.

BACKGROUND OF THE INVETION

Through the couplings at the tending-side end of different rolls in a paper machine, such as suction rolls and variable-crown rolls, and in paper finishing machines, such as variable-crown rolls or heated rolls in calenders, various media are passed into the rolls. These media include, for example, energy media, such as pressurized hydraulic fluid or compressed air, lubricating media, such as lubrication oil or water, and cleaning media, such as pressurized water. Further, in connection with the tending-side end of a roll, there may be various other couplings, such as a pressure equaling pipe and a lubricant exhaust pipe, setting and measurement apparatus for pressure and for positioning various members arranged inside the roll. For example, in the tending-side end of the forming suction rolls in the former of a paper machine, there are typically 6 large-diameter (e.g., diameter of about 60 mm) wash water couplings, 10 hydraulic couplings, an exhaust pipe for lubrication fluid at the tending side, a display of the meter for the vacuum level in the suction chamber, and devices for indicating the position of the vacuum box, as well as screws for regulating the positions of the edge seals of the suction chamber.

Depending on the extent of equipment, a suction roll in a paper machine includes, for example, the following couplings for the pipe system: at the tending side of the suction roll, a wash water coupling for the roll mantle, a wash water coupling for the suction box, a wash water coupling, 4 loading-air couplings, 3 locking-air couplings, input and outlet couplings for circulation lubrication of the bearing housings, and 2 grease lubrication couplings, and further, at the driving side, there are 2 grease lubrication couplings and input and outlet couplings for circulation lubrication of the bearing housings at the driving side.

In prior art suction rolls, the vacuum connection for the suction chamber has been arranged through the tubular shaft at the driving side.

In a manner known in the prior art, the couplings for media placed at the tending side of the rolls communicate with the supply pipes of the various media through metal-fabric reinforced hoses. The hoses have a length of about 1 to about 3 meters, and they are freely suspended. A particular problem is damage caused to the hoses in particular at the wet end of the paper machine. The hoses are curved, and chemicals adhere to the hose faces and harden the face of the hose. As a result of that, the face of the hose cracks, and the metal fabric in the interior of the hose is exposed. The metal fabric corrodes by the effect of the process waters, and there is an obvious risk of failure of the hoses. A damaged hose may cause dangerous situations, and the substance discharged from a hose has usually direct access to the wire circulation and causes even extensive disturbance in production and operation.

Failure of such hoses causes a considerable risk for safety at work, in particular if a highpressure hydraulic hose or hot-water hose is broken. Owing to this risk of damage, in many paper mills, the hoses are replaced, on the average, once a year for the sake of security. This causes a considerable expense both in the form of the installation work, the material, and in the form of standstills in operation. These long hoses often extend to the tending platforms and thus, cause a risk of tumbling and deteriorate the visual contact and the access to the servicing points. Also, damaged oil hoses cause a considerable risk for the environment because oil that enters into the wire circulation is likely to end up in a waterway. Attempts have been made to counteract damage to the various hoses by means of various fixing means and connecting pieces which keep the hoses apart from one another and thus, reduce the risk of damage arising from rubbing of the hoses against one another.

In prior art coupling arrangements for the tending-side ends of the rolls in paper machines, the confusion of the couplings is also a drawback, which confusion is an obvious drawback both in view of the operation and from an aesthetic point of view. A further drawback is the differences between different couplings and the resulting complication and high cost of the spare parts system and maintenance.

In a manner known from the prior art, in calenders for paper, on the cylindrical coupling part at the tending-side end of the calender rolls, a hood-like shield casing has been used, but this casing has not been sealed in any way, nor have the various problems mentioned above and related to the coupling hoses been solved by means of this protective casing.

OBJECTS AND SUMMARY OF THE INVENTION

Accordingly, an object of the present invention is to provide overall solutions for the problems and drawbacks mentioned above.

It is a particular object of the invention to provide a coupling for the end of a roll in order to protect the hoses for transfer of energy and instrumentation from contaminants, such as stock and lye.

It is a particular object of the invention to provide a coupling by whose means it is possible to increase the service life of the coupling parts and to make the couplings stronger and more solid.

It is a further particular object of the invention to improve the visual appearance of the paper machine and to facilitate and clarify maintenance operations.

It is a further object of the invention to provide a coupling for rolls which can be used as an almost standard configuration throughout the entire paper machine, which increases the uniformity of the visual appearance of the machine and facilitates the maintenance and lowers the costs of spare parts.

It is another object of the invention to provide a coupling for rolls by whose means it is possible to reduce the noise level at least to some extent, for, as is well known, for example, suction rolls are considerable sources of noise.

Advantages of the present invention come out with particular emphasis expressly at a suction roll and in the wet end of a paper machine, where the process conditions are highly demanding. However, it should be emphasized that the invention also provides solutions and advantages over the entire length of the paper machine and in paper finishing machines, such as calenders.

It is a particular object of the invention to provide a coupling arrangement for rolls in connection with which it is possible to apply a more concentrated and more protected energy transfer chain.

In view of achieving the objects stated above and others, the coupling arrangement in accordance with the invention comprises an openable shield casing which is tightly connected with the tending-side end of a roll and a coupling flange or coupling flanges, to which the various pipes and/or hoses have been attached. In the interior of the shield casing, there are connecting pipes and/or hoses which connect the pipe parts or equivalent of the roll end with the hose and/or pipe parts departing from the coupling arrangement.

In the following, the outlines of the constructional features, advantages and properties of a particularly advantageous embodiment of the invention will be described. Also, herein the terms "conduits", "pipes" and "hoses" are used interchangeably whereby the term "conduit means" encompasses pipes and hoses and other equivalent members through which a fluid flows.

In accordance with the invention, a shield casing that can be opened and closed is arranged in connection with the end of the roll, and the lengths of the connecting conduits, i.e., hoses and pipes, of the roll are minimized. To this end, a connecting plate is attached to the end of the roll preferably perpendicularly to the roll end or, alternatively, parallel to the roll end directly onto the roll end. This plate operates as a multiple terminal coupling for all of the pipes passing into the roll. The passage from the connecting plate into the roll takes place by means of fixed hard pipes, which make an elbow of about 90°. The multiple terminal coupling accomplished by means of the connecting plate minimizes any errors in the attaching of the hoses. Correspondingly, on the frame, the pipes are passed with optimal concentration to the vicinity of the suction roll. In the hoses, a slack extra length is provided just as needed for turning the suction roll, for example about ±70.

The conduits, which may be hoses and/or pipes, passing to the roll are preferably bundled together by means of a plastic piece, which prevents rubbing of the hoses against one another. Around the hoses, a shield casing is fitted, which can be opened and closed and which prevents access of stock and waters directly onto the faces of the hoses. The shield casing is an integrated part of the suction roll, and in the overall solution of the machine, the shield casing may indicate the type of the roll, e.g., include a unique identification symbol or have a unique identifying color. In such a case, it is possible to see the type of a roll from afar. The code may be a shield dome of different color and/or a visible symbol on the casing. An end casing for a roll may be provided in new machines and also in renewals as well as when a new process roll is supplied separately.

Longer service life of hoses, improved security, and clarity of layout at the machine are additional values provided by the present invention, which additional values are valuable for a paper mill.

The material of the shield casing employed in the present invention must endure the environment in the wet end. The material is, for example, a plastic grade that endures lye and oils very well. The shield casing is manufactured, for example, of a through-colored plastic by means of a vacuum molding process or, alternatively, by laminating out of fibreglass. The shield casing must not constitute an obstacle for maintenance operations, and it must not slow down the replacement of a roll, at least not to a substantial extent. Maintenance operations include turning of the interior part ("soul") in a suction roll (there must be visual contact with the scale indicating the position of the inner parts), reading of meters, and lubrication from grease nipples.

In connection with the invention, it is possible to employ a support piece which keeps the hoses/pipes tightly in a bundle and prevents their rubbing against one another. The material of the support piece must endure oils and lye, and the bundle arrangement must permit turning of the roll. For a bundle of hoses, a so-called energy transfer chain is a typical shield. If the hoses are not protected, damaging takes place in the same way as earlier and, moreover, replacement of the hoses is more difficult.

One embodiment of the coupling arrangement in accordance with the invention, in which the roll includes first conduit members through which the energy media passes, comprises a movable shield casing connected to the tending-side end of the roll, at least one coupling flange connected to the tending-side end of the roll, second conduit members situated at least partially exterior of the shield casing, each in flow communication with a respective first conduit member, and connecting conduit members for connecting each first conduit member in the roll and the respective second conduit member exterior of the roll. The connecting conduit members are situated in an interior of the shield casing and at least one connecting conduit member is connected to the coupling flange(s). The shield casing is preferably movable between a first position in which access to the connecting conduit members is prevented and a second position in which access to the connecting conduit members is enabled. The shield casing may comprise an annular part fixedly attached to the tending-side end of the roll, a coupling casing part fixedly attached to the annular part, and a movable mantle part arranged such that when the shield casing is in the first position, the mantle part is fitted on the annular part and closes the shield casing. The coupling flange may be directly or indirectly attached to a frame of the roll.

In certain embodiments, the shield casing comprises a truncated conical mantle part having a narrower, outer end and a wider, inner end, the narrower, outer end being closed, and a connecting part interposed between the inner end of said mantle part and the tending-side end of the roll. The shield casing may have a singular outer appearance such that when a plurality of shield casings are arranged at ends of a plurality of rolls in the paper machine, the shield casings all have the same outer appearance. In the alternative, the shield casing may have a specific, unique color such that when a plurality of shield casings are arranged at ends of a plurality of different rolls in the paper machine, the color of each shield casing enables a quick identification of the associated roll. Further, the shield casing may have a specific, unique identification symbol such that when a plurality of shield casings are arranged at ends of a plurality of different rolls in the paper machine, the identification symbol of each shield casing enables a quick identification of the associated roll.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
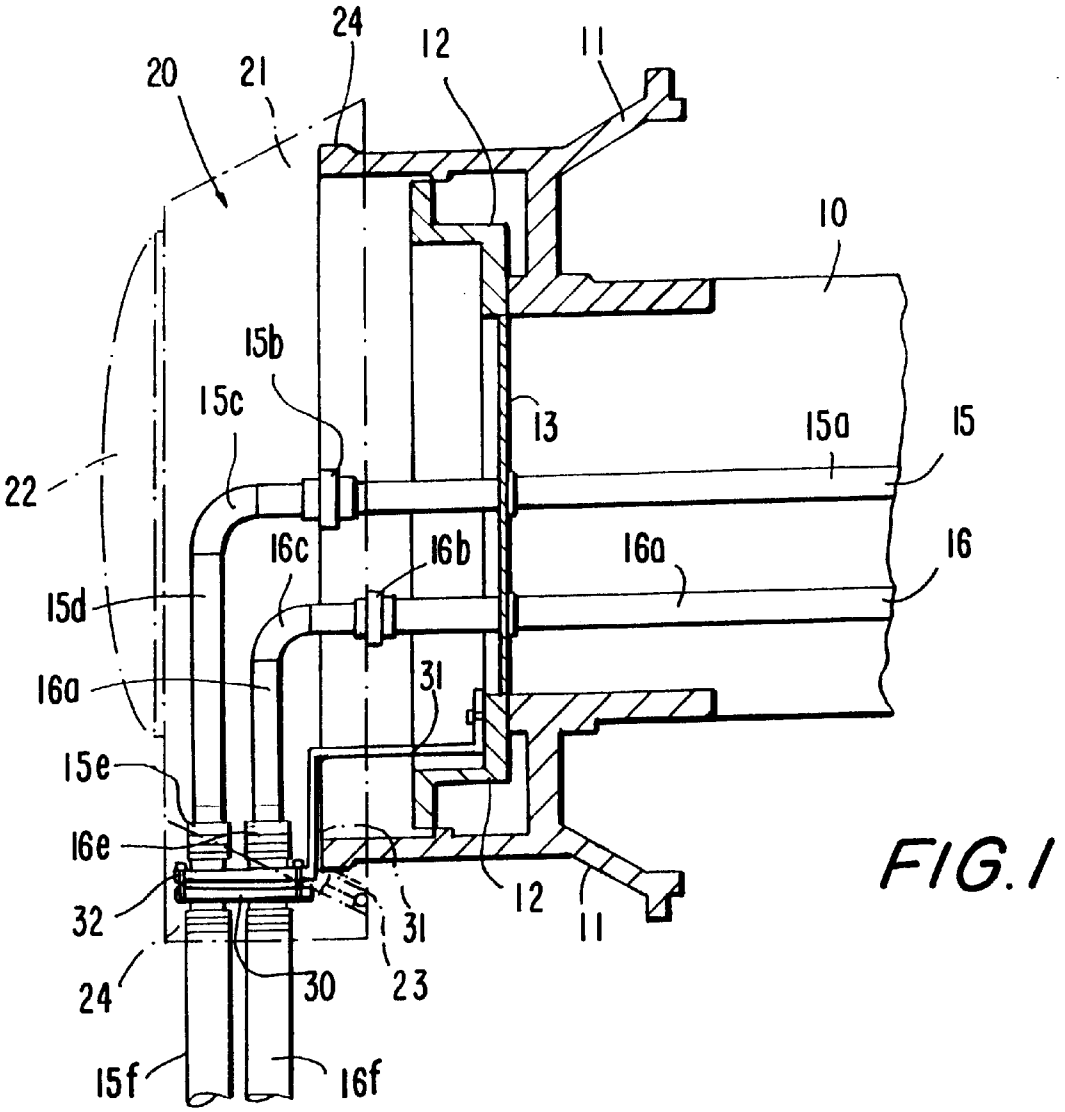
FIG. 1 is a sectional view of the end of a suction roll and a coupling arrangement in accordance with the invention fined in connection with the roll end taken along the plane passing through the central axis of the suction roll.

Referring to the accompanying drawings wherein like reference numerals refer to the same or similar elements, FIG. 1 shows a typical construction of the tending-side end of a suction roll 10 and, in its connection, a coupling arrangement in accordance with the invention of the different connecting conduits, such as pipes and hoses. The roll 10 shown in FIG. 1 is, for example, the upper forming suction roll 10, shown in FIG. 5 in an area of a forming gap G in a twin-wire former of a paper machine. It can also be some other roll mentioned above in a paper machine or paper finishing machine, for which roll, the hose and pipe couplings are needed for passing different media and coupling other connections.

Figure 2:
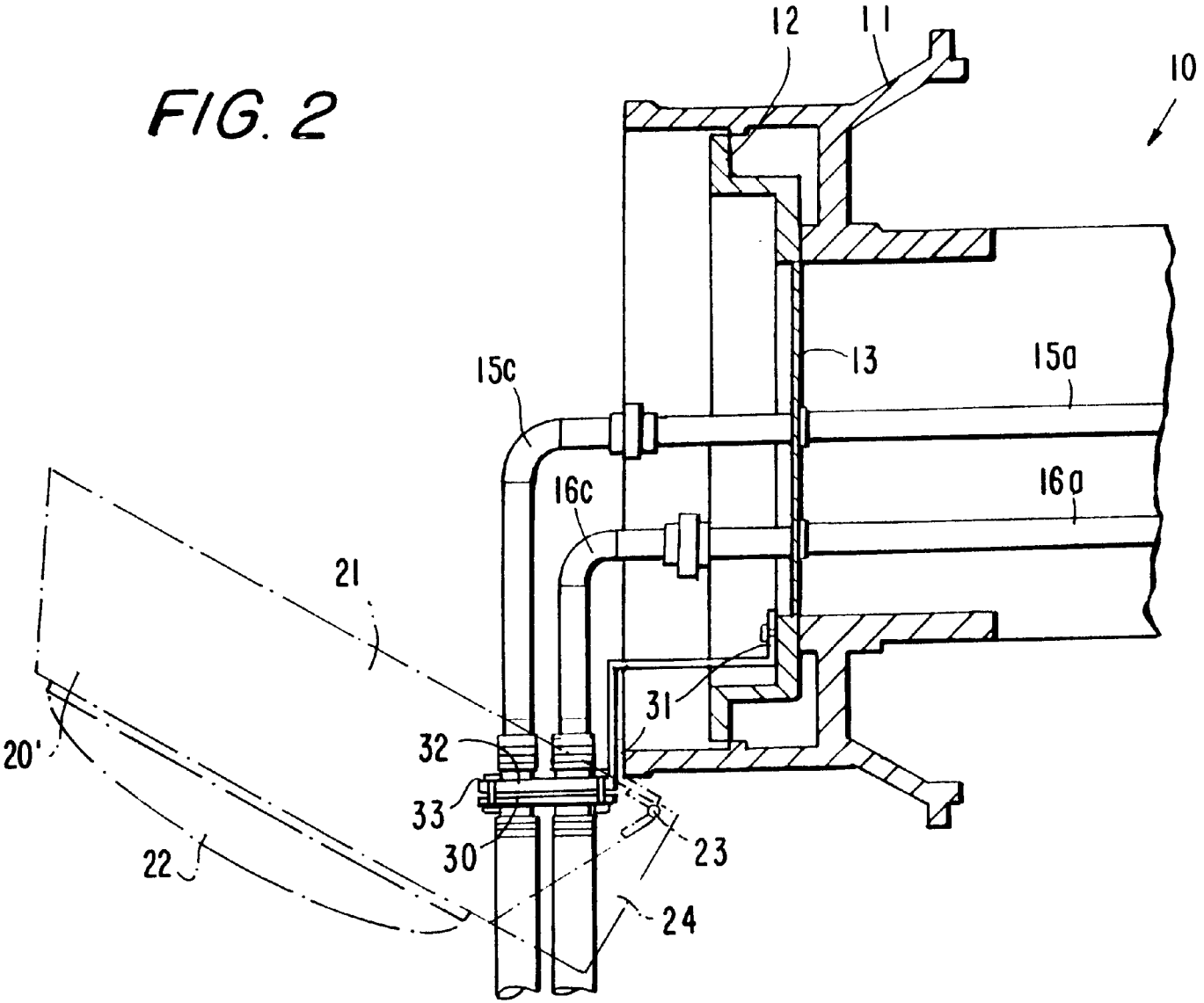
FIG. 2 shows a coupling arrangement similar to that shown in FIG. 1, wherein the end casing of the suction roll has been pivoted into the open position.
Figure 3:
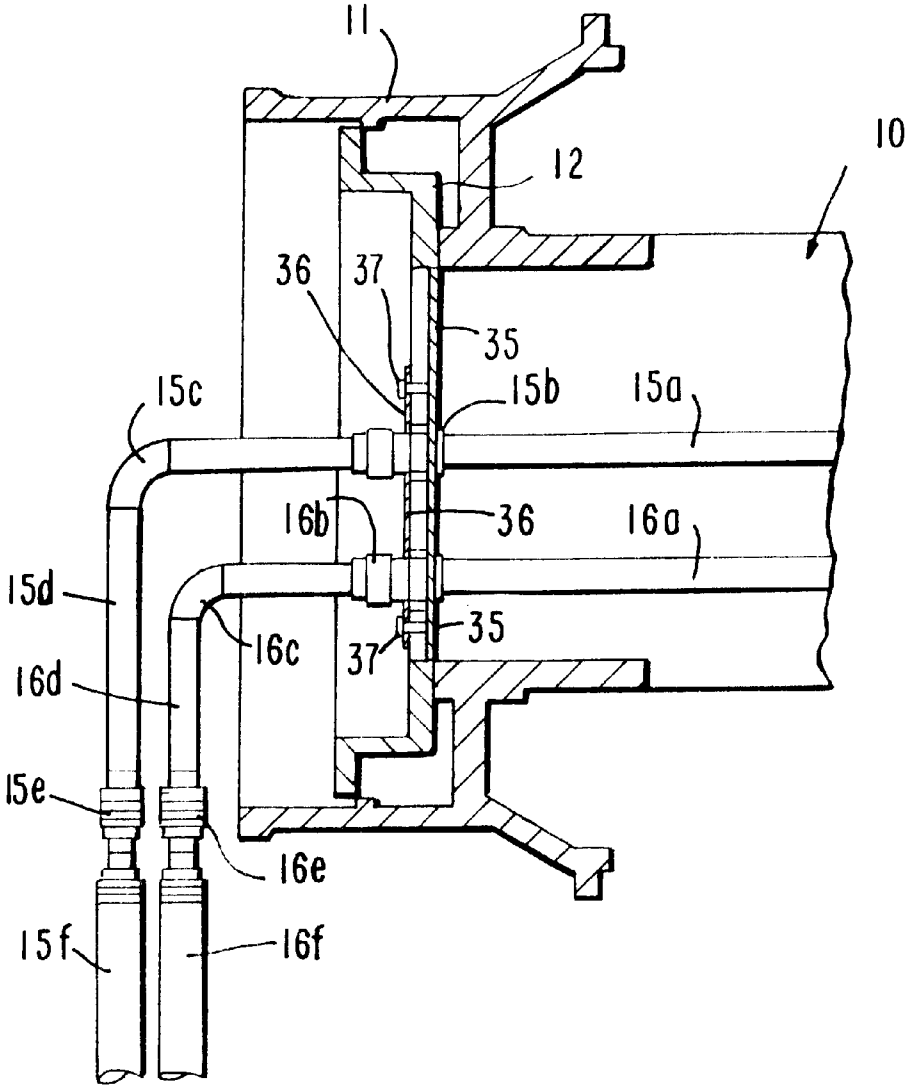
FIG. 3 shows a second embodiment of the invention in a manner corresponding to FIGS. 1 and 2, in which embodiment the end casing has been omitted for the sake of clarity of illustration, even though the end casing is an essential part also included in the coupling arrangement shown in FIG. 3.

In the embodiment shown in FIGS. 1, 2 and 3, the roll includes an outer annular frame part 11 and an inner annular frame part 12 arranged at the stationary end of the suction roll 10, and in FIGS. 1 and 2, additionally a vertical end plate 13 is seen, through which conduit members such as pipes 15,16 pass into the interior of roll 10. Pipes 15,16 in the interior of the roll 10 are arranged substantially parallel to an axis of the roll and in a substantially horizontal direction. FIGS. 1–3 show just two pipe connections passing into the interior of the suction roll 10, but in practice the number of conduit members such as pipes, hoses and other connections is considerably higher, but in FIGS. 1–3 many of them have not been shown for the sake of clarity of the illustrations.

As shown in FIGS. 1–3, the pipes 15,16 include an axial fixed pipe portion 15*a*,16*a*, respectively, which is connected by means of fittings 15*b*,16*b*, through 90° elbow pieces 15*c*, 16*c*, to vertical fixed pipe portions 15*d*, 16*d* arranged in a substantially vertical direction. The latter pipe portions 15*d*,16*d* are connected by means of fittings 15*e*,16*e* to hose parts 15*f*, 16*f*, which are parts of a hose bundle 17 shown in FIG. 5 and are situated exterior of the roll 10 and at least partially exterior of the shield casing 20. Thus, the pipes 15,16 constitute conduit members arranged in the interior of the roll 10, the hose parts 15*f*,16*f* constitute conduit members arranged exterior of the roll 10 and fittings 15*b*,16*b*, elbow pieces 15*c*,16*c*, vertical pipe portions 15*d*,16*d* and fittings 15*e*,16*e* constitute connecting conduit members for connecting a respective pipe 15,16 to the hose part 15*f*, 16*f*. The hose bundle 17 is connected through a valve plate 18*a* and related valves 18*b* with a pipe cassette 18*c*, from which the different ducts pass further through a lead-in to sources and equivalent of different media and equivalent.

As shown in FIGS. 1 and 2, a coupling flange 30 is fixed by means of an intermediate part 31 in connection with the annular frame part 11 of the suction roll 10. In connection with this coupling flange 30, by means of a connection plate 32 and screws 33, the pipe portions 15*d*, 16*d* and their respective fittings 15*e*, 16*e* have been mounted fixedly and solidly. Connection plate 32 may be considered a locking and tightening flange since it fixedly mounts the pipe portions 15*d*,16*d* and fittings 15*e*,16*e* (FIG. 1). After the fixed pipe portions 15*d*, 16*d* and the coupling flange 30, the ducts proceed as hose parts 15*f*,16*f*. In addition to, or instead of, the coupling 30,31,32,33 shown in FIG. 1, it is possible to use a plate-like coupling flange 35 shown in FIG. 3 and fitted in connection with the inner annular part 12 of the suction roll, to which flange 35, the axial pipe portions 15*a*, 16*a* and their respective fittings 15*b*, 16*b* have been fixed by means of a connection plate 36 and screws 37. Connection plate 36 may also be considered a locking and tightening flange since it fixedly mounts the elbow pipe portions 15*c*,16*c* and fittings 15*b*,16*b* (FIG. 3).

The coupling arrangement in accordance with the invention includes a movable shield casing 20 fitted in connection with the end of the roll 10 to cover and to protect the various couplings described above and further couplings. The shield casing 20 is connected with the frame part 11 of the roll 10 by means of a hinge joint 23 or other articulated connecting means. In FIG. 1, the shield casing 20 is shown in the closed position, in which the inner edge of the shield casing is, at point 24, sufficiently tight in order to prevent access of contaminants into the interior of the shield casing 20.

In FIG. 3, the shield casing has been omitted in view of clarity of illustration, even though the casing belongs to the construction shown in FIG. 3 as an essential part. In FIG. 2, the shield casing 20 is shown in the position 20' in which it has been pivoted down around the hinge joint 23, in which case, free, unhindered access is provided to the various couplings and ducts of the roll end for maintenance and installation work etc.

The shield casing 20 comprises a mantle part 21 shaped as a truncated cone, i.e., having a narrower, outer end and a wider, inner end, and a dome part 22 connected with it tightly at the outer end to close the same, which dome part 22 has preferably been made transparent so that the connections and possible meters and regulation apparatus placed inside the shield casing 20 can be examined through the dome part 22 when the shield casing 20 is in the closed position as shown in FIG. 1. Mantle part 21 may be arranged to be substantially coaxial with an axis of rotation of the roll 10. In connection with the outer edge of the annular part 11 and/or with the inner edge of the mantle part 21 placed against the annular part 11, if necessary, there are appropriate sealing arrangements, which make the shield casing 20 sufficiently tight in its closed position. If necessary, the shield casing 20 is supported in the closed position by means of fastening devices, which are not shown.

The mantle part 21 and/or the dome part 22 of the shield casing 20 can be provided with unique symbols and/or identification colors, which are distinguished clearly and directly so that the shield casing 20 fitted at the end of the roll 10 concerned clearly identifies the nature of the roll 10 concerned. The dome part 22 does not necessarily have to be transparent, and it can be marked with a identification color and/or with an identification symbol that is readily distinguishable.

Figure 4:
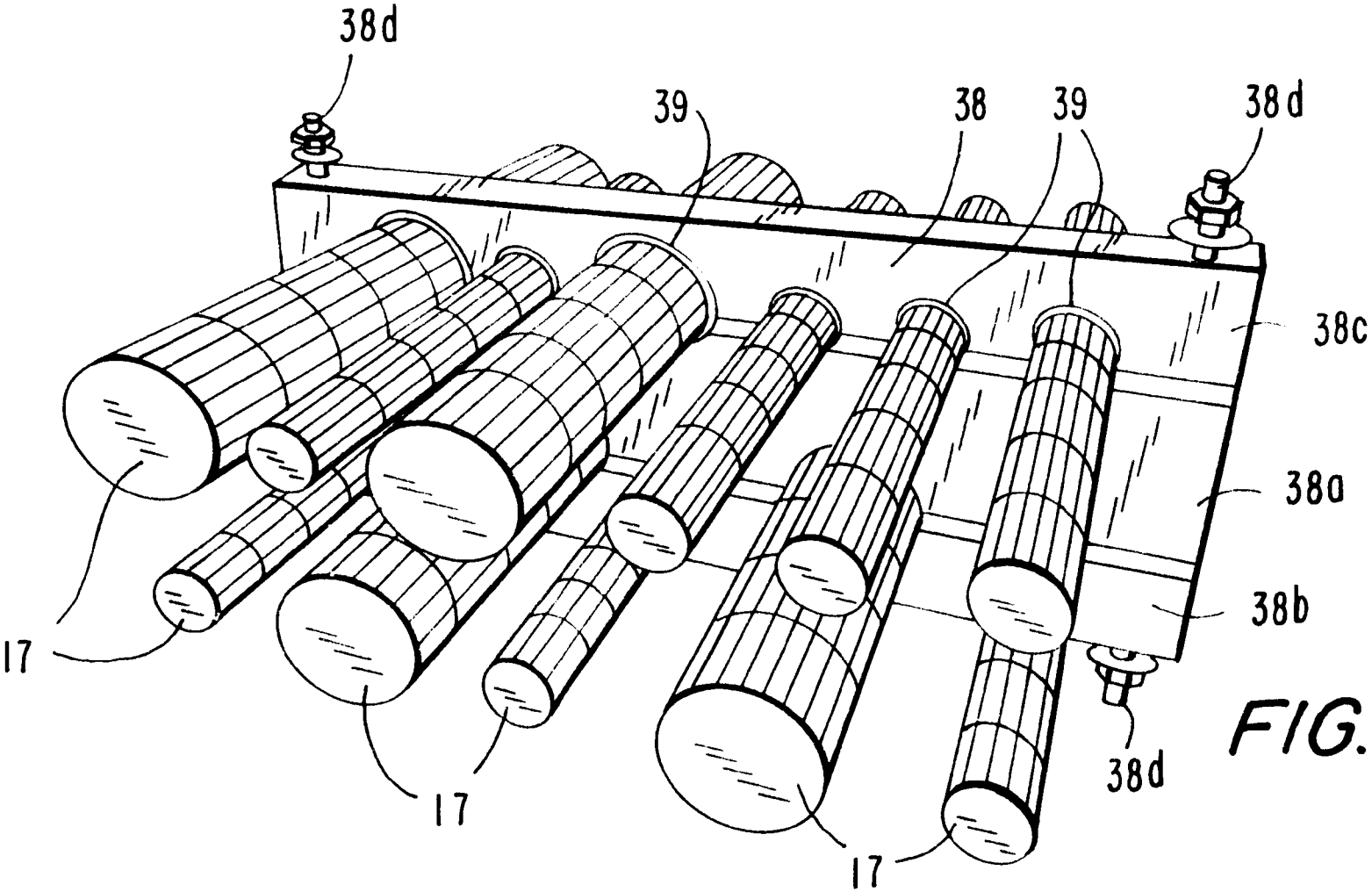
FIG. 4 is a perspective view of a binding piece for hoses and pipes for use in connection with a coupling arrangement in accordance with the invention.

FIG. 4 is an axonometric view of a support piece 38, by whose means the different pipes and hoses 17 can be bound together inside or outside the shield casing 20. The support piece 38 comprises parts 38*a*,38*b*,38*c*, whose opposite sides are provided with holes 39 for the pipes and/or hoses 17 and/or equivalent connecting parts. From one end, the parts 38*a*,38*b*,38*c* are interconnected by means of fastening screws 38*d* so that the pipes and/or hoses 17 or equivalent are connected tightly with the holes 39 and, thereby, with the support piece 38. If necessary, the support piece 38 can be connected to some stationary frame part directly or through an intermediate part.

Figure 5:
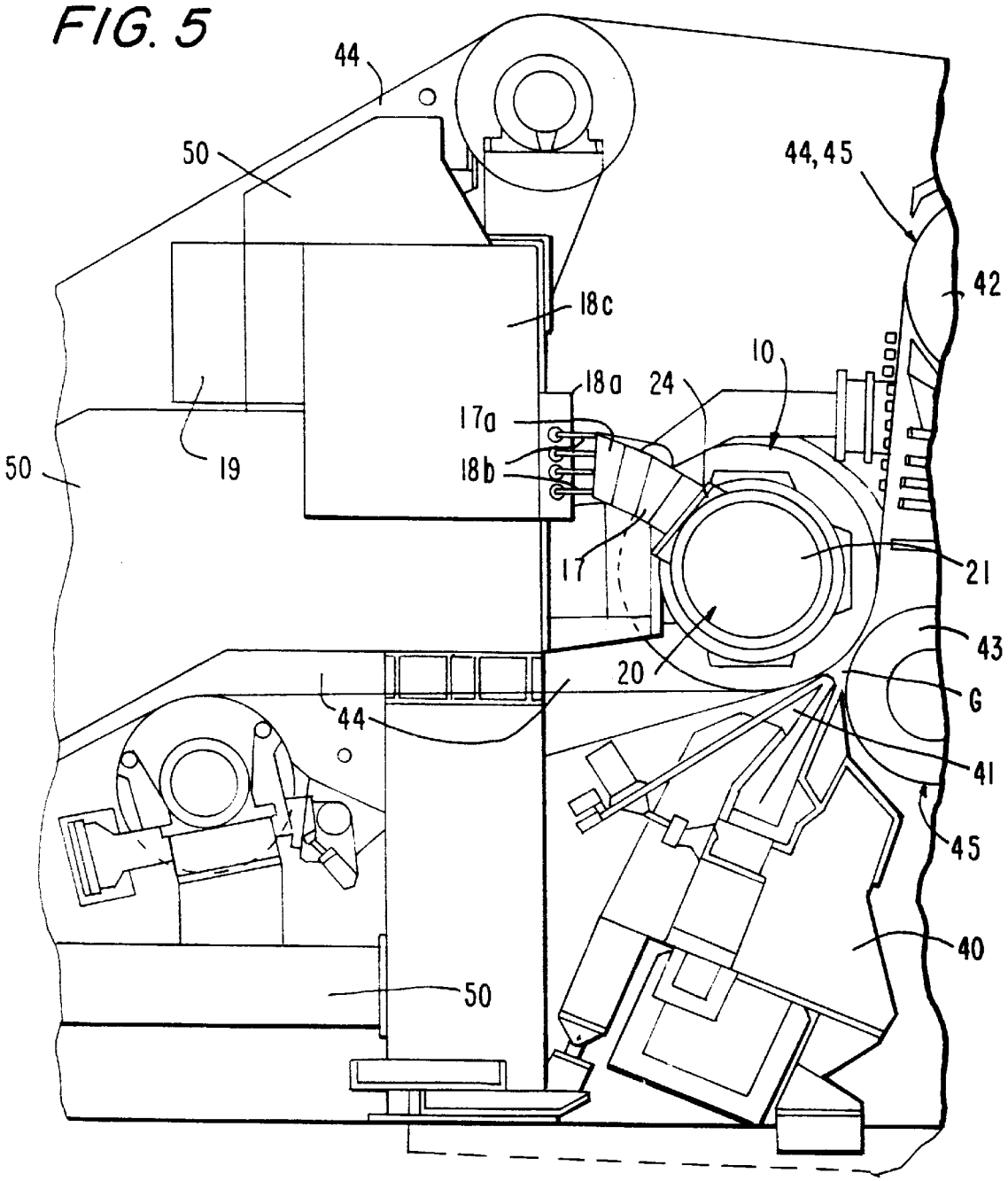
FIG. 5 is a schematic side view of a typical environment of application of a coupling arrangement in accordance with the invention, i.e., a forming suction roll in a twin-wire former and the further connecting of the coupling arrangement with other connections.

FIG. 5 shows a typical environment of application of a coupling arrangement in accordance with the invention, to which environment the invention is, however, by no means confined. A coupling part in accordance with the invention is used, in the way shown in FIG. 5, in connection with the forming suction roll 10 of a twin-wire former in a paper machine. In a manner in itself known, the former comprises a headbox 40, and a stock suspension jet is discharged from the slice gap of a slice part 41 of the headbox 40 into the forming gap G between the forming wires 44 and 45, which gap is defined between the forming suction roll 10 and the breast roll 43. From the shield casing 20 in accordance with the invention for the coupling arrangement for the end of the forming roll 10, a protected lead-in 24 departs, through which a bundle of hoses 17 passes, which is, if necessary, joined together by means of a support piece 38 as shown in FIG. 4, and the bundle of hoses is passed to the valve plate 18*a* and through the valves 18*b* placed at the plate into a box-like pipe cassette 18*c*. From here, the necessary pipes and couplings are passed further through the lead-in 19 placed in connection with a frame part 50 of the former. In connection with the lead-in 24, on the bundle of hoses 17, there is a shield casing 17*a*, which is composed of U-section or O-section parts liked together with each other, out of which parts it is possible to assemble curved box parts. In this manner, a so-called energy transfer chain is formed, which protects the bundle of hoses 17. Above the forming suction roll 10, inside the loop of the carrying wire 45, there is a second upper forming suction roll 42, of which just a part is shown and in whose connection there can also be a coupling arrangement in accordance with the invention with its shield casing 20.

Figure 6:
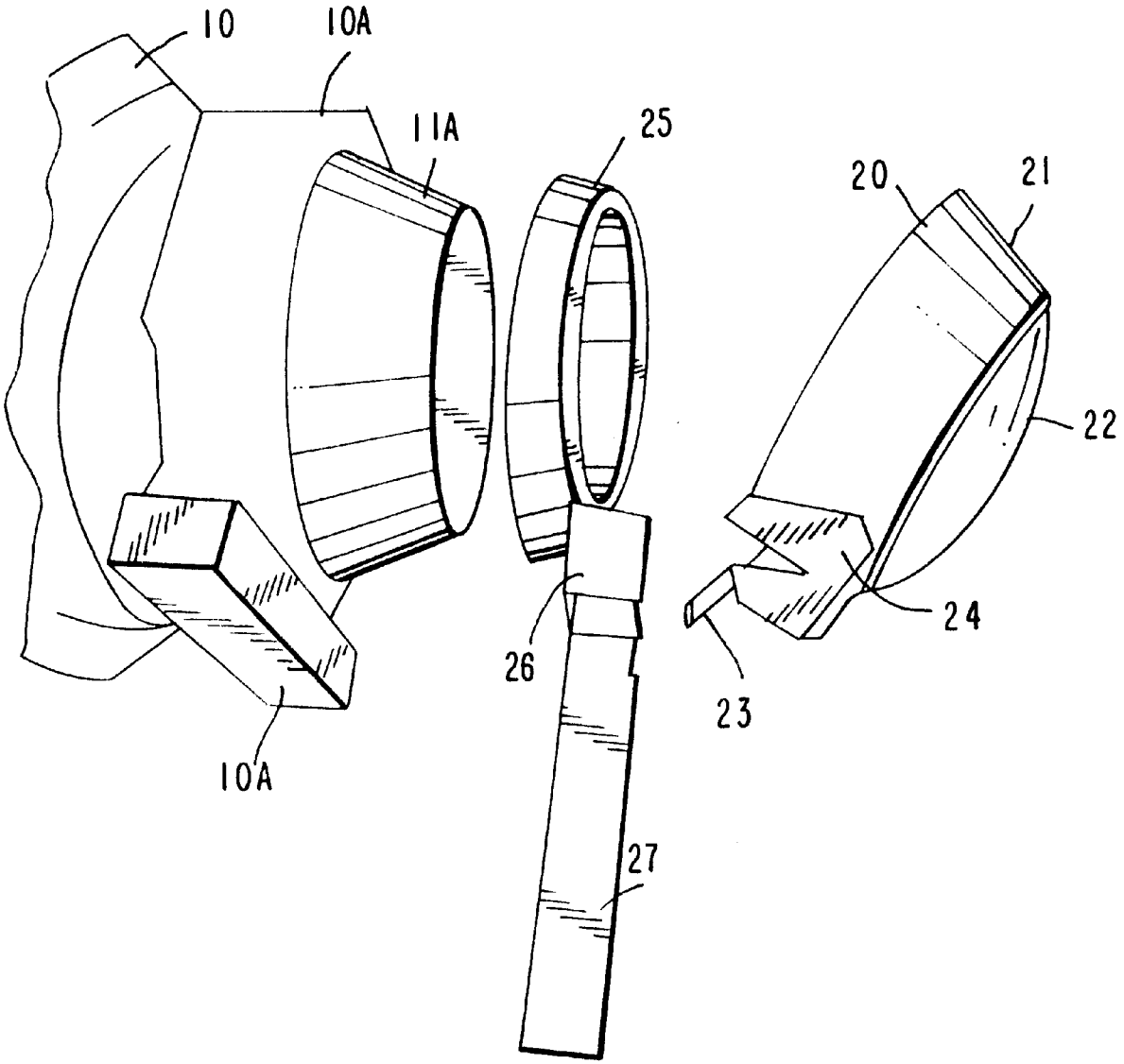
FIG. 6 is an exploded view of a coupling arrangement in accordance with the invention.

FIG. 6 is an exploded view of a variation of the coupling arrangement in accordance with the invention. FIG. 6 shows the roll 10, its bearing support 10A, and an end part 11A of the roll shaped as a truncated cone. Differing from the embodiments shown in FIGS. 1–3, the coupling arrangement comprises an annular intermediate part 25 substantially shaped as a truncated cone, which part 25 is attached onto the frame part 11A. To the annular part 25, a coupling casing part 26 is attached, from which a shield casing 27 for the different hoses departs. The shield part 27 is comprised, for example, of interlinked mantle portions, which form a so-called energy transfer chain. To the annular part 25 and/or to the coupling casing part 26, one hinge blade of the hinge part 23 is attached so that the connecting part 24 of the shield casing 20 is placed on the coupling casing part 26 when the shield casing 20 is in the closed position. In the other respects, the shield casing 20 is similar to that described above.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A coupling arrangement for a tending-side end of a roll in a paper machine through which energy media are passed into the roll, the roll including first conduit members through which the energy media passes, comprising at least one coupling flange connected to the tending-side end of the roll, second conduit members, each of said second conduit members being in flow communication with a respective one of said first conduit members, connecting conduit members, at least one of said connecting conduit members being structured and arranged to connect a respective one of said first conduit members in the roll and the respective one of said second conduit members exterior of the roll, at least one of said at least one connecting conduit member being connected to said at least one coupling flange, and a shield casing having an interior thereof said second conduit members situated at least partially exterior of said shield casing and said connecting conduit members arranged in the interior of said shield casing, said shield casing movably connected to the tending-side end of the roll and being movable between a first position in which access to said connecting conduit members is prevented and a second position in which access to said connecting conduit members is enabled.

2. The coupling arrangement of claim 1, wherein said first conduit members are arranged parallel to an axis of the roll and in a substantially horizontal direction and said second conduit members are arranged in a substantially vertical direction, said connecting conduit members comprising pipes fixed relative to the roll, said pipes including a 90° elbow part.

3. The coupling arrangement of claim 1, wherein said shield casing comprises an annular part fixedly attached to the tending-side end of the roll, a coupling casing part fixedly attached to said annular part, and a movable mantle part arranged such that when said shield casing is in said first position, said mantle part is fitted on said annular part and closes said shield casing.

4. The coupling arrangement of claim 1, wherein said shield casing comprises a transparent dome part.

5. The coupling arrangement of claim 1, wherein said at least one coupling flange is directly attached to a frame of the roll.

6. The coupling arrangement of claim 1, wherein said at least one coupling flange is indirectly attached to a frame of the roll.

7. The coupling arrangement of claim 1, wherein said shield casing comprises a truncated conical mantle part having a narrower, outer end and a wider, inner end, said narrower outer end being closed, and a connecting part interposed between said inner end of said mantle part and the tending-side end of the roll.

8. The coupling arrangement of claim 3, wherein said mantle part shaped as a truncated cone and is substantially coaxial with an axis of rotation of the roll.

9. The coupling arrangement of claim 1, further comprising articulated connection means for pivotally connecting said shield casing to the tending-side end of the roll, said articulated connection means comprising a hinge shaft such that said shield casing is pivotable about said hinge shaft.

10. The coupling arrangement of claim 9, wherein said hinge shaft is arranged in a vicinity of said at least one coupling flange.

11. The coupling arrangement of claim 1, wherein the roll includes an inner annular frame part, said shield casing being attached to the inner annular frame part of the roll.

12. The coupling arrangement of claim 1, wherein said at least one connecting flange comprises a single connecting flange, further comprising a locking and tightening flange for fixedly mounting at least one of each of said connecting conduit members to said connecting flange.

13. The coupling arrangement of claim 1, wherein said shield casing comprises a connecting part through which said second conduit members pass into the interior of said shield casing.

14. The coupling arrangement of claim 1, wherein said shield casing has a singular outer appearance such that when a plurality of said shield casings are arranged at ends of a plurality of rolls in the paper machine, said shield casings all have the same outer appearance.

15. The coupling arrangement of claim 1, wherein said shield casing has a specific, unique color such that when a plurality of said shield casings are arranged at ends of a plurality of different rolls in the paper machine, the color of each of said shield casings enables a quick identification of the associated roll.

16. The coupling arrangement of claim 1, wherein said shield casing has a specific, unique identification symbol such that when a plurality of said shield casings are arranged at ends of a plurality of different rolls in the paper machine, the identification symbol of each of said shield casings enables a quick identification of the associated roll.

17. The coupling arrangement of claim 1, wherein said shield casing comprises a connecting part through which said second conduit members pass into the interior of said shield casing, said connecting part including a lead-in part and an outer mantle, said second conduit members being passed into the interior of said shield casing through said lead-in part, further comprising a valve plate to which said second conduit members are connected exterior of said shield casing, and a pipe cassette for housing said second conduit members.

18. The coupling arrangement of claim 1, further comprising third conduit members, each connected to a respective one of said second conduit members, and a coupling piece arranged exterior of said shield casing and having holes through which said third conduit members pass to thereby supporting all of said third conduit members.

* * * * *